US011771976B2

(12) United States Patent
Valenches

(10) Patent No.: US 11,771,976 B2
(45) Date of Patent: Oct. 3, 2023

(54) BALL THROWING MACHINE AND SYSTEM

(71) Applicant: Michael Robert Valenches, Glastonbury, CT (US)

(72) Inventor: Michael Robert Valenches, Glastonbury, CT (US)

( * ) Notice: Subject to any disclaimer, the term of this patent is extended or adjusted under 35 U.S.C. 154(b) by 94 days.

(21) Appl. No.: 17/567,290

(22) Filed: Jan. 3, 2022

(65) Prior Publication Data

US 2022/0266115 A1 Aug. 25, 2022

Related U.S. Application Data

(60) Provisional application No. 63/153,062, filed on Feb. 24, 2021.

(51) Int. Cl.
*A63B 69/40* (2006.01)
*F41B 4/00* (2006.01)

(52) U.S. Cl.
CPC ..... *A63B 69/406* (2013.01); *A63B 2069/403* (2013.01); *A63B 2069/405* (2013.01); *A63B 2210/50* (2013.01)

(58) Field of Classification Search
CPC ..... A63B 69/406; A63B 2069/0008; A63B 2069/403; A63B 2069/405; A63B 2210/80; F41B 4/00

(Continued)

(56) References Cited

U.S. PATENT DOCUMENTS 3,774,584 A * 11/1973 Paulson ..... A63B 69/406 124/78
4,080,950 A * 3/1978 Paulson ..... A63B 69/406 124/1

(Continued)

OTHER PUBLICATIONS

SKLZ Lightening Bolt Pitching machine; https://www.academy.com/shop/pdp/sklz-lightning-bolt-pro-pitching-machine; printed Feb. 19, 2021.

(Continued)

*Primary Examiner* — Alexander R Niconovich
(74) *Attorney, Agent, or Firm* — Michael A Blake

(57) ABSTRACT

A ball throwing machine system comprising: a housing, the housing comprising a bottom of the housing; an adjustable stand with a base, the base in operational communication with the bottom of the housing via a mechanical joint means, and wherein the housing can lockably move with respect to the base, a first ball inlet located in the housing; a first ball corridor located in the housing and in communication with the first ball inlet; a first ball outlet located in the housing and in communication with the first ball corridor and the first ball inlet; a second ball inlet located in the housing; a second ball corridor located in the housing and in communication with the second ball inlet; a second ball outlet located in the housing and in communication with the second ball corridor and the second ball inlet; a single wheel configured to rotate at user adjustable speeds, and further configured to impart spin and velocity to a ball, wherein the outer surface of the single wheel is located on the floor of the first ball corridor, and wherein the outer surface of the single wheel is located on the ceiling of the second ball corridor. A ball throwing machine comprising: a housing, the housing comprising a bottom of the housing; a first ball inlet located in the housing; a first ball corridor located in the housing and in communication with the first ball inlet; a first ball outlet located in the housing and in communication with the first ball corridor and the first ball inlet; a second ball inlet located in the housing; a second ball corridor located in the housing and in communication with the second ball inlet; a second ball outlet located in the housing and in communication with the second ball corridor and the second ball inlet; a single wheel configured to rotate at user adjustable speeds, and further configured to impart spin and velocity to a ball, wherein the outer surface of the single wheel is located on the floor of the first ball corridor, and wherein the outer (Continued)

surface of the single wheel is located on the ceiling of the second ball corridor and wherein the bottom of the housing is configured to moveably and lockably attach to an adjustable stand, and wherein the housing can lockably move with respect to the adjustable stand.

16 Claims, 15 Drawing Sheets

(58) Field of Classification Search
USPC ..... 124/1, 6, 78, 81
See application file for complete search history.

(56) References Cited

U.S. PATENT DOCUMENTS 4,197,827 A * 4/1980 Smith ..... A63B 69/406 124/78
RE30,703 E * 8/1981 Paulson ..... A63B 69/406 124/1
4,561,414 A * 12/1985 Nozato ..... A63B 69/406 124/78
4,760,835 A * 8/1988 Paulson ..... A63B 69/406 124/78
4,841,945 A * 6/1989 Braden ..... A63B 69/406 124/78
5,437,261 A * 8/1995 Paulson ..... A63B 69/406 124/78
5,722,384 A * 3/1998 Cox ..... A63B 69/40 124/78
5,735,256 A * 4/1998 Monk ..... F41B 11/641 124/81
5,826,568 A * 10/1998 Van Ross, Jr. ..... A63B 69/406 124/6
5,832,909 A * 11/1998 Grant ..... A63B 69/406 124/6
5,964,209 A * 10/1999 Boehner ..... A63B 69/406 124/78
6,093,117 A * 7/2000 Sherlock ..... A63B 69/406 124/78
6,164,271 A * 12/2000 Paulson ..... A63B 69/406 124/78
6,305,366 B1 * 10/2001 Rizzo ..... A63B 69/406 124/6
6,402,640 B1 * 6/2002 Stuart ..... A63B 69/406 124/78
6,488,020 B1 * 12/2002 Rosas-Magallan ..... A63B 69/406 124/78
6,508,243 B1 * 1/2003 Long ..... A63B 69/40 124/78
6,672,297 B1 * 1/2004 Liao ..... A63B 69/406 124/78
6,732,724 B1 * 5/2004 Paulson ..... A63B 69/406 124/78
6,895,949 B1 * 5/2005 Stephens ..... F41B 4/00 124/6
7,231,913 B2 * 6/2007 Wilson ..... A63B 69/406 124/78
7,383,832 B2 * 6/2008 Soberg ..... A63B 69/406 124/6
7,448,370 B2 * 11/2008 Lu ..... A63B 69/406 124/6
7,900,618 B1 * 3/2011 Angermeier ..... A63B 69/406 124/6
7,958,876 B2 * 6/2011 Lay ..... A63B 69/406 124/78
8,074,633 B2 * 12/2011 Grant ..... A63B 69/406 124/78
8,707,942 B2 * 4/2014 Lu ..... A63B 69/406 124/78
9,579,554 B1 * 2/2017 Madden ..... A63B 69/408
10,631,522 B2 * 4/2020 So ..... A01K 15/025
2005/0252498 A1 * 11/2005 Donald ..... A63B 69/406 124/6
2006/0135290 A1 * 6/2006 Lin ..... A63B 69/0002 124/78
2009/0095273 A1 * 4/2009 Paulson ..... A63B 69/0002 124/78
2015/0114377 A1 * 4/2015 Yoo ..... A63B 69/406 124/6
2021/0354021 A1 * 11/2021 Hannallah ..... A63B 69/406

OTHER PUBLICATIONS

Personal Pitcher Pro; https://www.hittingstore.com/personal-pitcher-pro-pitching-machine/?gclid=Cj0KCQiA4L2BBhCvARIsAO0SBdYWPPJXiiOvcpDRhrPWHJjjWeEUOaLZ%E2%80%A6; printed Feb. 19, 2021.
MAXBP Original Pitching Machine; https://www.maxbp.com/collections/pitching-machines/products/maxbp-original- pitching-and-reaction-training-machine; printed Feb. 19, 2021.
Heater Pro Real Curveball Machine with Auto Ballfeeder; https://www.heatersports.com/responsive/product_details.php?id=HTR499BB&c=catagorie; printed Feb. 19, 2021.

* cited by examiner

BALL THROWING MACHINE AND SYSTEM

CROSS-REFERENCES

This patent application claims priority to provisional patent application No. 63/153,062, filed on Feb. 24, 2021, by Michael Robert Valenches and titled: "BALL THROWING MACHINE" which provisional application is fully incorporated by reference herein.

TECHNICAL FIELD

The present invention relates to a ball throwing machine, and more particularly to a ball throwing machine that is easily and quickly adjustable.

BACKGROUND

In the sports of baseball and softball it can be challenging to train athletes under game like conditions. A key element of these sports is the pitch of the ball, and the subsequent reactions of both the batter and the catcher to the thrown ball. For athletes in recreational leagues or on interscholastic sports teams it can be difficult for the athletes to get the exposure to pitched ball variation and the repetitions required to improve their skills. The methods currently being used to meet the required repetitions and overall exposure to a pitched ball for training purposes varies greatly depending on the level of play and the money available to invest in training. Where little money is available for training, pitched ball repetition to both a batter and catcher can be achieved by having a coach or pitcher throw the balls. Although this form of training allows the catchers and batters to interact directly with pitched balls, the variety of ball movement, ball speeds and their repetitions are limited by the coach's or pitcher's abilities. Another option to expose athletes to pitched balls is by using a ball throwing machine. Ball throwing machines are capable of reproducing pitched ball speeds and trajectories. The one problem with existing ball throwing machines is their inability to produce pitch to pitch variation in both ball placement and trajectory. In order to change the thrown ball trajectory and location the machine operator needs to re-adjust the machine. This can require multiple steps and can sometimes require the batter to step away while the machine is being adjusted. The time taken to re-adjust the machine and the lack of pitch to pitch variation detract from the training experience.

Thus there is a need for a ball throwing machine that overcomes the above listed and other disadvantages.

SUMMARY OF THE INVENTION

The disclosed invention relates to a ball throwing machine system comprising: a housing, the housing comprising a bottom of the housing; an adjustable stand with a base, the base in operational communication with the bottom of the housing via a mechanical joint means, and wherein the housing can lockably move with respect to the base, a first ball inlet located in the housing; a first ball corridor located in the housing and in communication with the first ball inlet; a first ball outlet located in the housing and in communication with the first ball corridor and the first ball inlet; a second ball inlet located in the housing; a second ball corridor located in the housing and in communication with the second ball inlet; a second ball outlet located in the housing and in communication with the second ball corridor and the second ball inlet; a single wheel configured to rotate at user adjustable speeds, and further configured to impart spin and velocity to a ball, wherein the outer surface of the single wheel is located on the floor of the first ball corridor, and wherein the outer surface of the single wheel is located on the ceiling of the second ball corridor.

The disclosed invention also relates to a ball throwing machine comprising: a housing, the housing comprising a bottom of the housing; a first ball inlet located in the housing; a first ball corridor located in the housing and in communication with the first ball inlet; a first ball outlet located in the housing and in communication with the first ball corridor and the first ball inlet; a second ball inlet located in the housing; a second ball corridor located in the housing and in communication with the second ball inlet; a second ball outlet located in the housing and in communication with the second ball corridor and the second ball inlet; a single wheel configured to rotate at user adjustable speeds, and further configured to impart spin and velocity to a ball, wherein the outer surface of the single wheel is located on the floor of the first ball corridor, and wherein the outer surface of the single wheel is located on the ceiling of the second ball corridor and wherein the bottom of the housing is configured to moveably and lockably attach to an adjustable stand, and wherein the housing can lockably move with respect to the adjustable stand.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

The disclosed ball throwing machine is capable of rapidly changing ball trajectories, positions and speeds. The design of this throwing machine allows the machine operator to freely manipulate the thrown ball's position and trajectory at will by aiming the machine using the integrated hand grip providing superior pitch to pitch variation. The versatility of this machine allows the machine to be rapidly setup and used in a wide variety of training environments providing players more opportunities to train and gain the repetitions needed to improve their skills. The disclosed ball throwing machine is different from all other ball throwing machines because of its ability to be freely manipulated by the machine operator allowing them to rapidly change the ball's trajectory, position and speed. The disclosed ball throwing machine consists of a ball throwing machine incorporating one or more ball throwing wheels. In one embodiment, the ball machine will be limited to one wheel, in this embodiment, additional wheels are not required and will actually limit functionality. To project a ball it is inserted into the throwing machine by one of two inlets or shoots to produce either topspin or backspin. The machine consists of a top shoot with the ball entering on one side to produce backspin. The throwing machine can be rapidly turned around and the ball inserted in the lower shoot to produce topspin. The rapid movement and versatility in machine positioning is achieved through the use of a ball and socket joint at the lower end of the throwing machine along with a handgrip for the operator to move the machine. This ball and socket type joint is capable of being operated in a locked position by tightening the ball against the socket housing by means of a locking screw. The machine can also be left free to move in the socket allowing the machine operator to freely aim the machine at will. The ball's spin, thrown position and trajectory are rapidly changed by the machine operator by changing the orientation of the machine. To add further versatility, the ball throwing machine also incorporates a speed selection switch to change the speed of the thrown ball.

Figure 1:
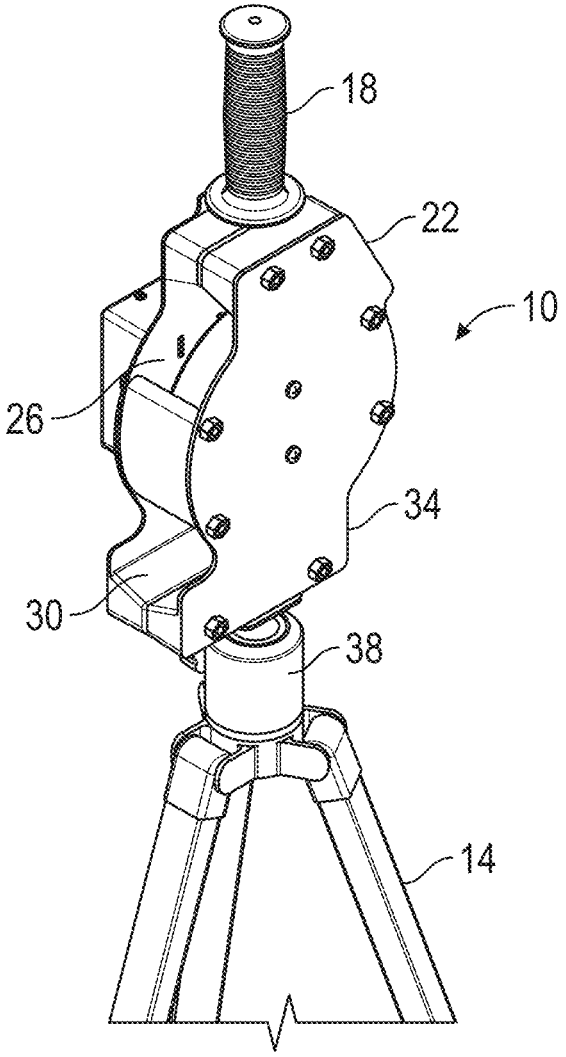
FIG. 1 is a front perspective view of the disclosed ball throwing machine installed on a tripod.

FIG. 1 is a front perspective view of the disclosed ball throwing machine 10 installed on an adjustable stand. In one embodiment, the adjustable stand may be a tripod 14. The machine 10 comprises a housing 82, and a handle 18 attached to the housing, the handle 18 has a vertical orientation in this embodiment. The machine 10 has a first ball inlet 22, and a first ball outlet 26. The machine 10 has a second ball inlet 30, and a second ball outlet 34. The housing 82 is moveably attachable to a base 38 via a mechanical joint means. In one embodiment, the machine has a ball member 86 attached to the bottom of the housing that is removeably attachable to the tripod 14 via a base 38 located on the tripod 14. In this embodiment, the base 38 is a ball socket configured to receive the ball member 86. In another embodiment, the base 38 may be part of the machine 10, and the base being configured to removeably attach to a tripod 14, with the ball member 86 configured to fit into the base 38. There are many other types of mechanical joint means that allow lockable movement between the housing 82 and the base 38 that are included in this ball throwing machine, such as, but not limited to universal joints, pivot joints, clevis joint, etc.

Figure 2:
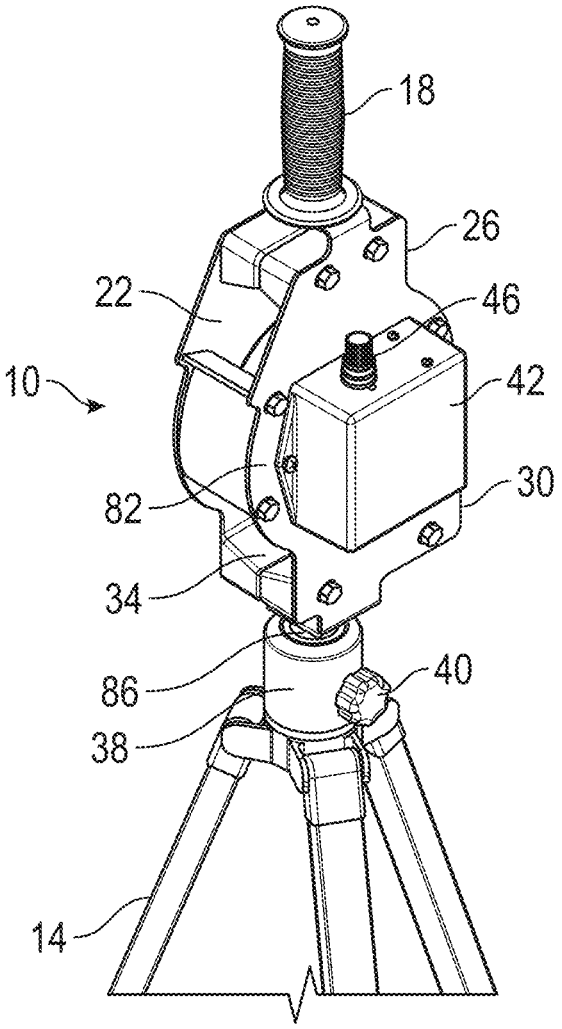
FIG. 2 is a rear perspective view of the disclosed ball throwing machine installed on a tripod.

FIG. 2 is a rear perspective view of the disclosed ball throwing machine 10 installed on a tripod 14. In this view a motor housing 42 is visible along with a motor control knob 46. In this view, a locking knob 40 is shown. The locking knob 40 can be tightened to lock the housing 82 with respect to the base 38. In one embodiment, the housing 82 may have a ball member 86 that is configured to fit inside the base 38, and when the knob 40 is tightened, the base 38 tightens about the ball, locking the housing 82 in place with respect to the base 38. The locking knob 40 can be loosened to allow the housing (and ball member 86) to rotate and move freely while still being attached to the base 38. Thus, the housing 82 can be moved with respect to the base 38, and then locked in position via the locking knob 40. In one embodiment, the housing 82 can rotate with respect to the base 38, pivot forward and back with respect to the base 38, pivot left to right and right to left with respect to the base 38, and pivot in any 360° direction with respect to the base 38.

Figure 3:
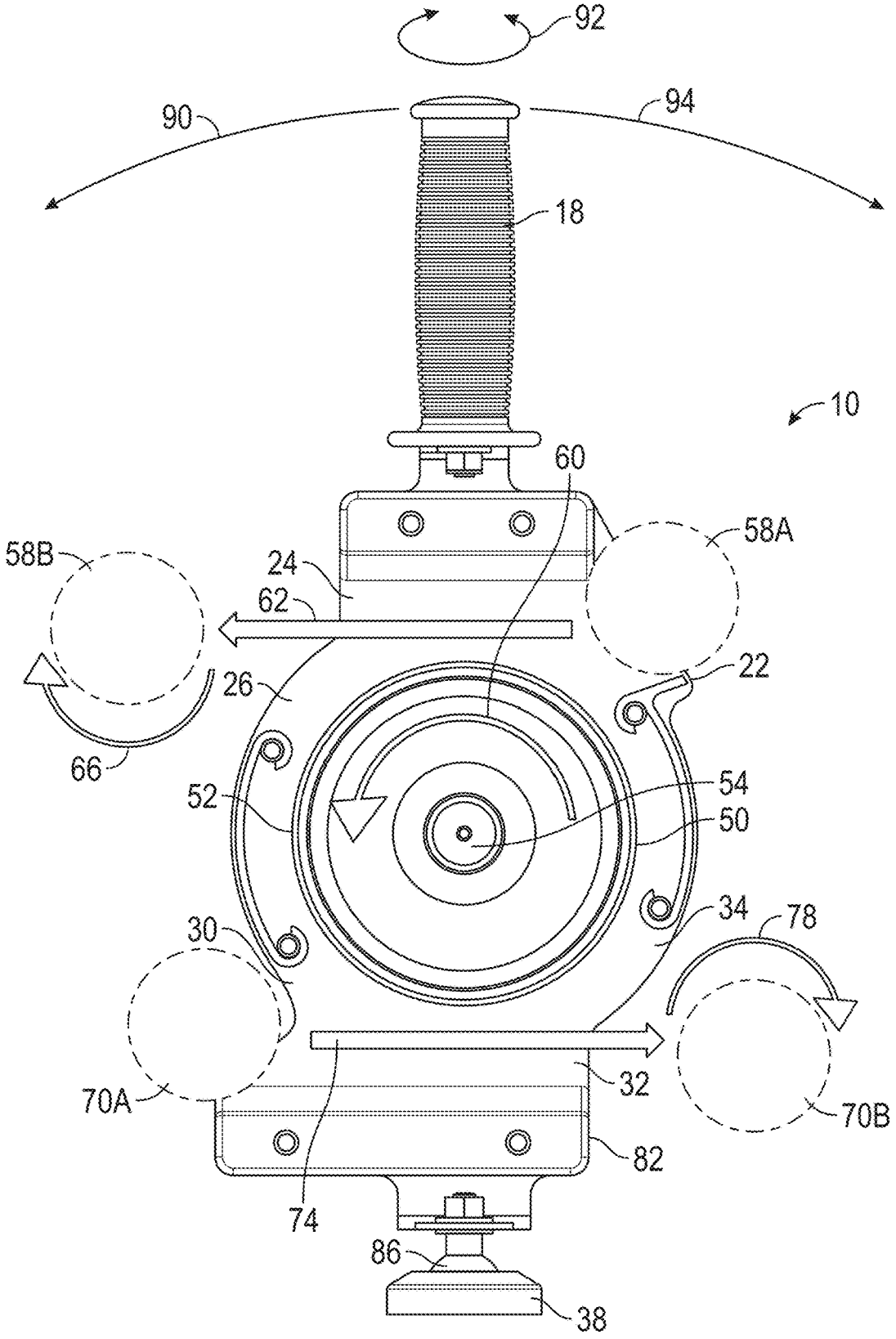
FIG. 3 is a right side sectional view of the ball throwing machine.

FIG. 3 is a right side sectional view of the ball throwing machine 10. In this view, a wheel 50 is shown inside the machine 10. The wheel 50 is connected to a drive shaft 54. The drive shaft 54 is connected to a motor (located inside the motor housing 42). When the motor is activated it rotates the drive shaft 54 and wheel 50 in the direction shown by arrow 60. When a user places a ball 58A in the first ball inlet 22, the wheel 50, when rotating, imparts spin and velocity and forces the ball generally along the direct of arrow 62 and ejects the ball 58B out of the first ball outlet 26. Ball 58 is represented by 58A when the ball 58 is about to be placed into the machine, and by 58B after the ball has been ejected by the ball machine 10. The housing 82 may form a first ball corridor 24 that is located between the first ball inlet 22 and the first ball outlet 26. The ball 58 travels from the first ball inlet 22 through the first ball corridor 24 and out the first ball outlet 26. The outer surface 52 of the wheel 50 forms at least a portion of the floor of the first ball corridor 24. The ball 58B will have underspin as shown by the arrow 66. Conversely, when a user places a ball 70A in the second ball inlet 30, the wheel 50, when rotating, imparts spin and velocity and forces the ball generally along the direction of arrow 74 and ejects the ball 70B out of the second ball outlet 34. The housing 82 may form a second ball corridor 32 that is located between the second ball inlet 30 and the second ball outlet 34. The ball 58 travels from the second ball inlet 30 through the second ball corridor 32 and out the second ball outlet 34. The outer surface 52 of the wheel 50 forms at least a portion of the ceiling of the second ball corridor 32. The ball 70B will have topspin as shown by the arrow 78. Ball 70 is represented by 70A when the ball 70 is about to be placed into the machine 10, and by 70B after the ball has been ejected by the ball machine 10. The ball throwing machine 10 comprises a housing 82. The housing 82 is moveably attached to the base 38 via a ball member 86. The housing 82 can rotate with respect to the base 38 along the direction shown by the arrows 90, 94. In addition the housing 82 can rotate counterclockwise or clockwise in the direction of the arrow 92. Also, the housing 82 can rotate towards and away from the viewer of FIG. 3. Thus the machine 10 can be aimed to eject the ball with underspin towards a player or a target. The machine 10 can be rotated either clockwise or counterclockwise, so that the machine can be aimed to eject the ball with top spin towards the player or the target. The housing 82 is able to rotate as shown due to the ball member 86 and base 38 interaction.

Referring to FIGS. 2 and 3, the locking knob 40 can be tightened to lock ball member 86 with respect to the base 38, so that the housing 82 is locked in place with respect to the base 38. The locking knob 40 can be loosened to allow the housing 82 (and ball member 86) to rotate and move freely while still being attached to the base 38.

Figure 4:
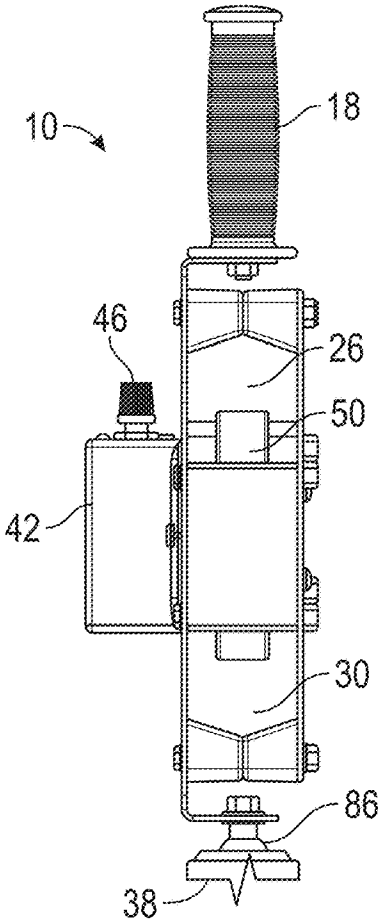
FIG. 4 is a front view of the ball throwing machine.

FIG. 4 shows a front view of the ball throwing machine 10.

Figure 5:
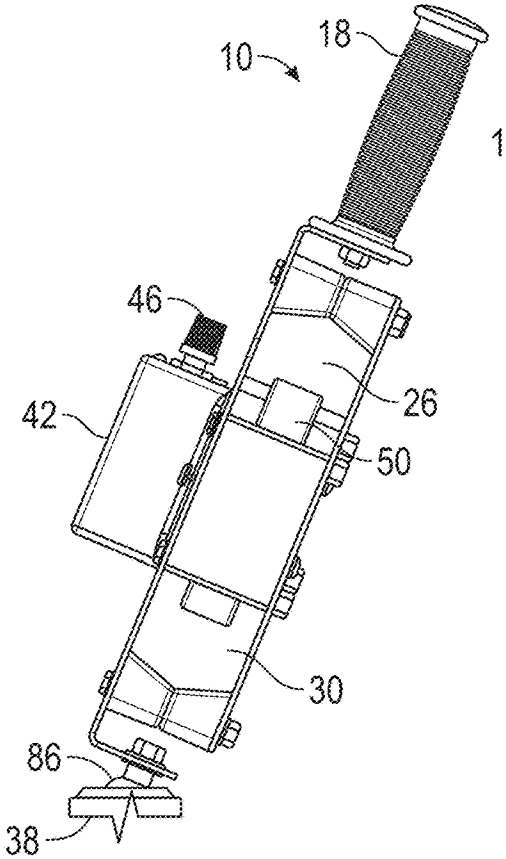
FIG. 5 is a front view of the ball throwing machine from FIG. 4 with the machine rotated to the right by approximately 30° with respect to the base.

FIG. 5 shows a front view of the ball throwing machine 10 from FIG. 4, but with the machine 10 rotated to the right by approximately 30° with respect to the base 38.

Figure 6:
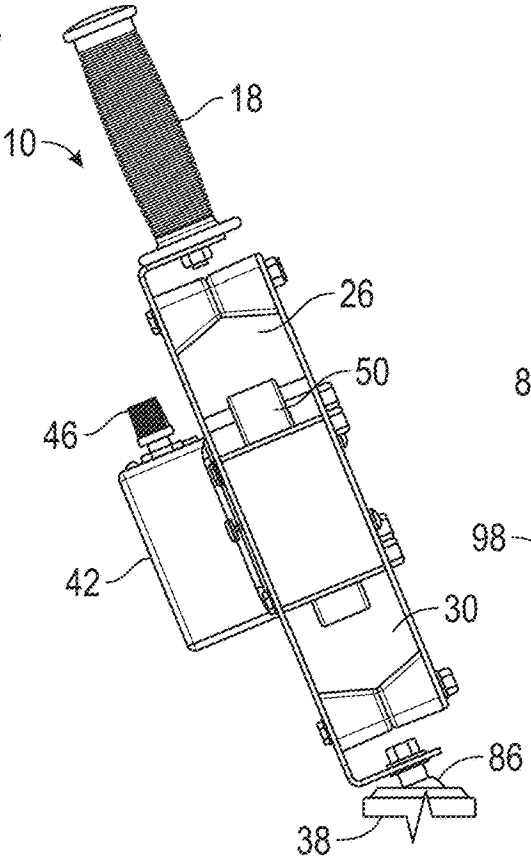
FIG. 6 is a front view of the ball throwing machine from FIG. 4 with the machine rotated to the left by approximately 30° with respect to the base.

FIG. 6 shows a front view of the ball throwing machine 10 from FIG. 4, but with the machine 10 rotated to the left by approximately 30° with respect to the base 38.

Figure 7:
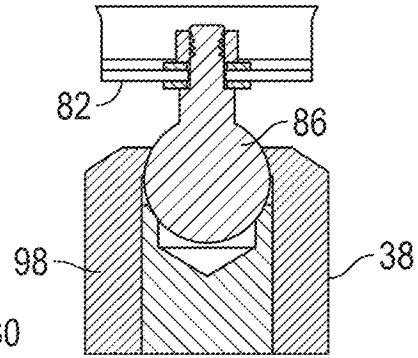
FIG. 7 is a close-up sectional view of the housing and socket base.

FIG. 7 is a close-up sectional view of the housing 82 and base 38. When the locking knob 40 is tightened the wall 98 of the base 38 tighten about the ball member 86, so that the ball member 86 is locked in place with respect to the base 38. When the locking knob 40 is loosened, the ball member 86 can rotate within the base 38, allowing the housing 82 to be positioned as the user desires with respect to the base 38. Thus the angle, direction, and trajectory, and spin of the ball being ejected from the ball throwing machine 10 can be changed depending on how the ball throwing machine 10 is positioned using the handle 18 and moving the housing 82 with respect to the base 38.

Figure 8:
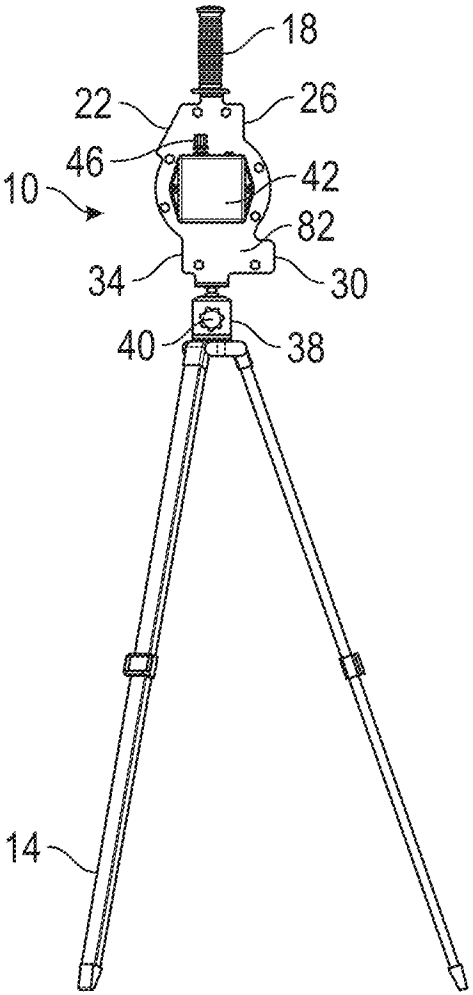
FIG. 8 is a right side view of the ball throwing machine installed on a tripod.

FIG. 8 is a right side view of the ball throwing machine 10 installed on a tripod 14.

Figure 9:
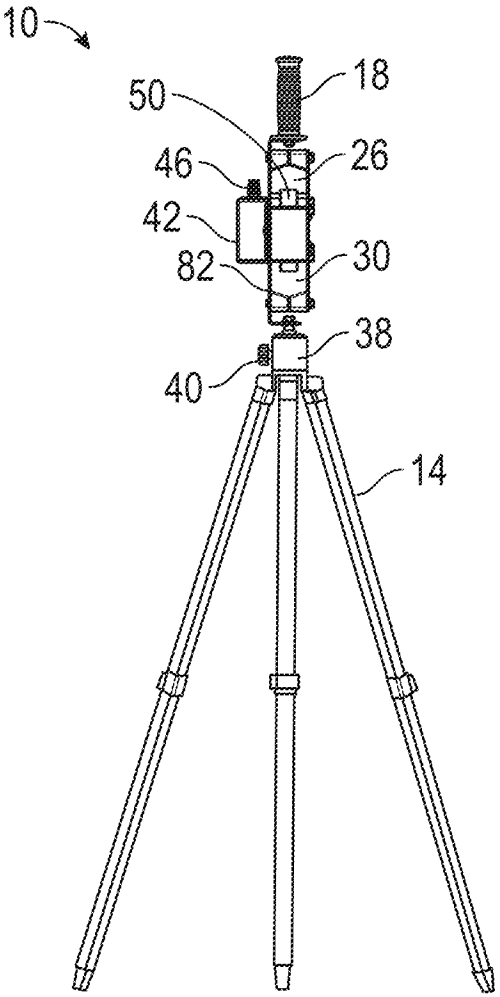
FIG. 9 is a front view of the ball throwing machine installed on a tripod.

FIG. 9 is a front view of the ball throwing machine 10 installed on a tripod 14.

Figure 10:
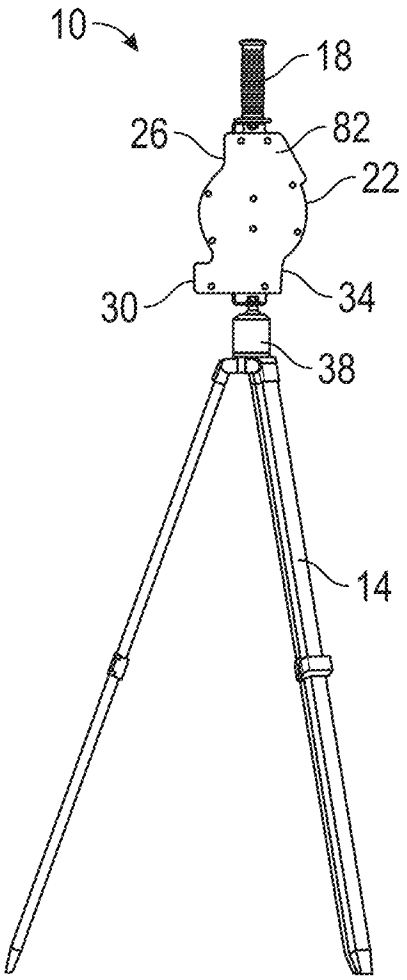
FIG. 10 is a left side view of the ball throwing machine installed on a tripod.

FIG. 10 is a left side view of the ball throwing machine 10 installed on a tripod 14.

In another embodiment, the ball 58, 70 may be a small, golf ball size, foam baseball. The ball throwing machine 10 will be configured to throw such a ball. Using this type of small and lightweight ball, the ball throwing machine 10 will not only have versatility in ball positioning, speed and trajectory, but do so with superior portability, weight reduction, ability to operate on battery or AC powered and the ability to safely operate indoors and outdoors with reduced risk of property damage or injury.

Figure 11:
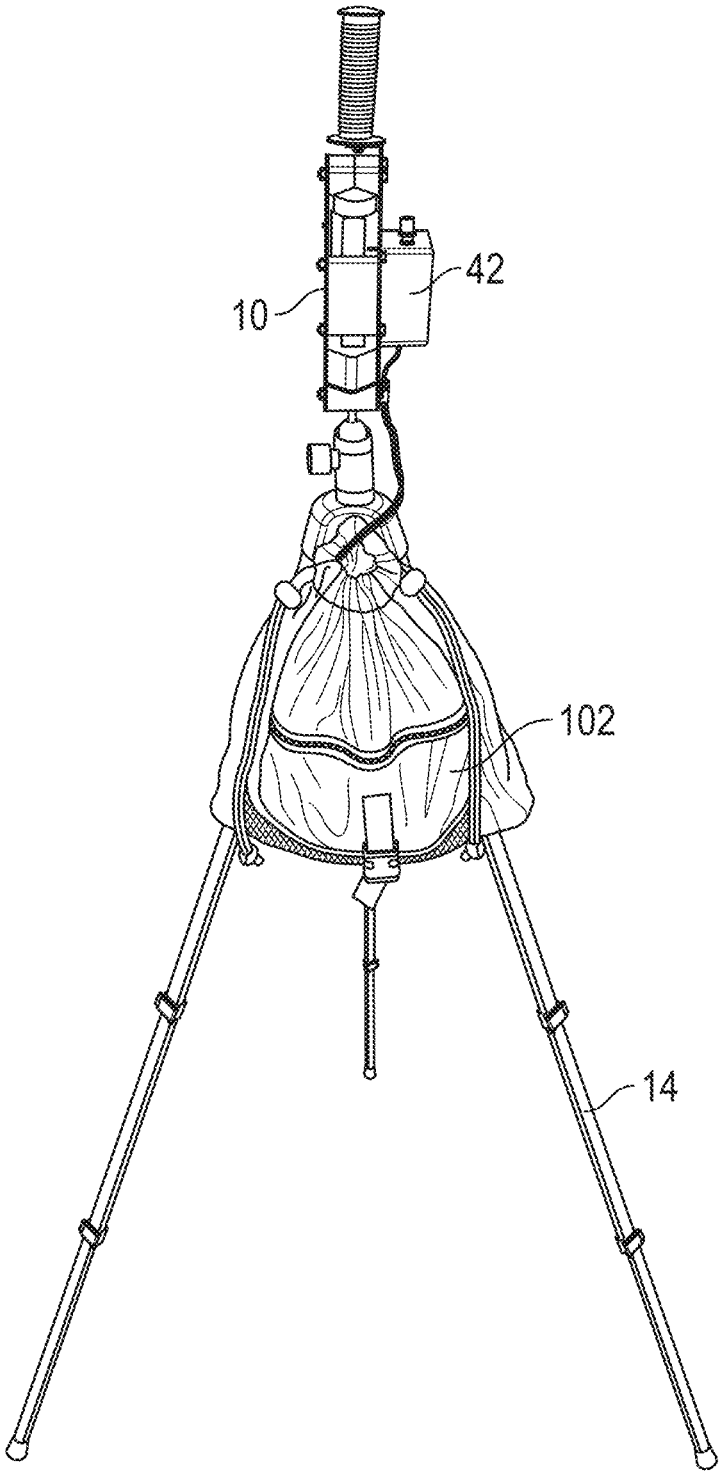
FIG. 11 is a rear view of the ball throwing machine installed on a tripod.

FIG. 11 is a rear view of the ball throwing machine 10 installed on a tripod 14. Also shown in this view is an optional bag 102. The bag 102 may be attached to the tripod 14. The bag 102 may be used to store baseball and/or softball related items such as balls, gloves, bats, etc. In addition, the bag 102 may be used to hold a power supply for the motor located in the motor housing 42.

Figure 12:
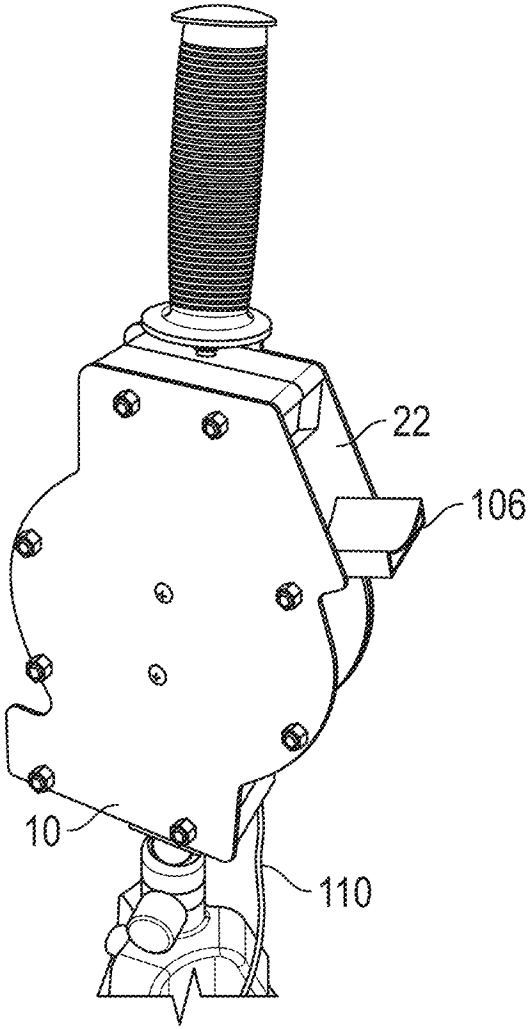
FIG. 12 is a side perspective view of the ball throwing machine from FIG. 11.

FIG. 12 is a side perspective view of the ball throwing machine 10 from FIG. 11. In this embodiment, the first ball inlet 22 comprises a feeder ramp 106. The feeder ramp 106 may be at an inclined angle to allow for feeding of balls into the inlet, and the angle of the feeder ramp 106 will allow gravity to pull the ball down into the inlet 22 and onto the first ball corridor 24. Also shown in this figure, is a power cord 110 that is connected to the motor inside the motor housing 42, and a power supply that may located in the bag (not seen in this view).

Figure 13:
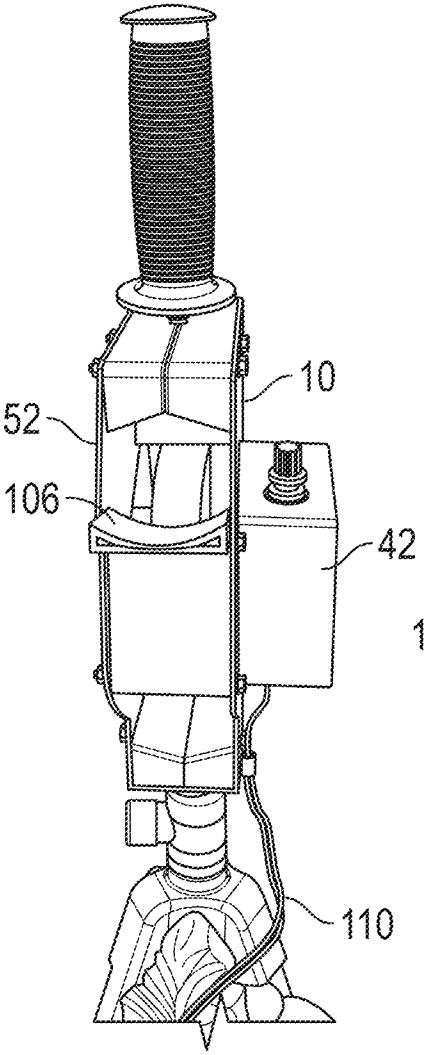
FIG. 13 is a rear view of the ball throwing machine from FIG. 12.

FIG. 13 is a rear view of the ball throwing machine 10 from FIG. 12.

Figure 14:
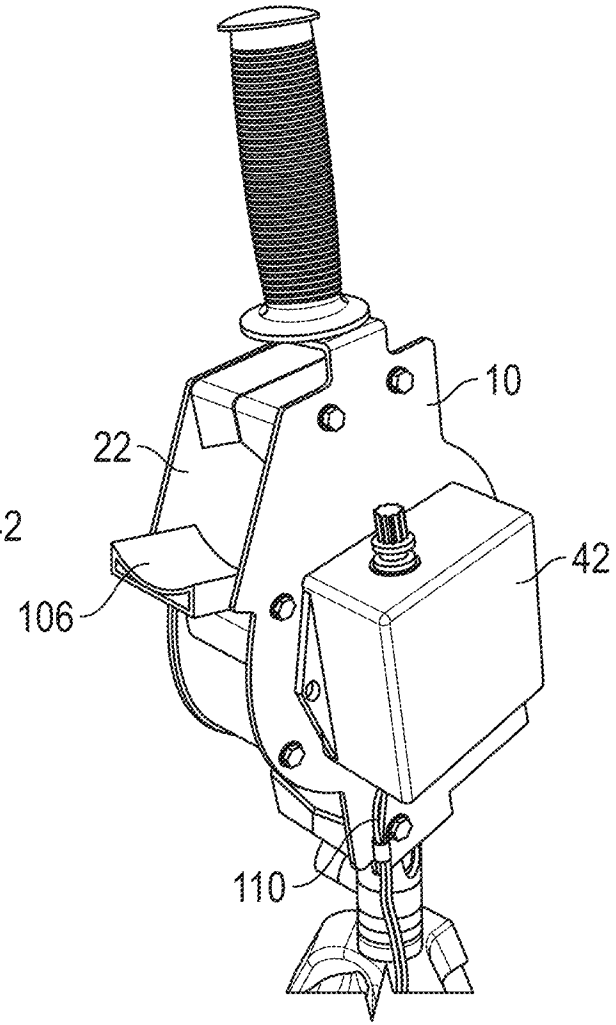
FIG. 14 is another side view of the ball throwing machine from FIG. 13.

FIG. 14 is another side view of the ball throwing machine 10 from FIG. 13.

Figure 15:
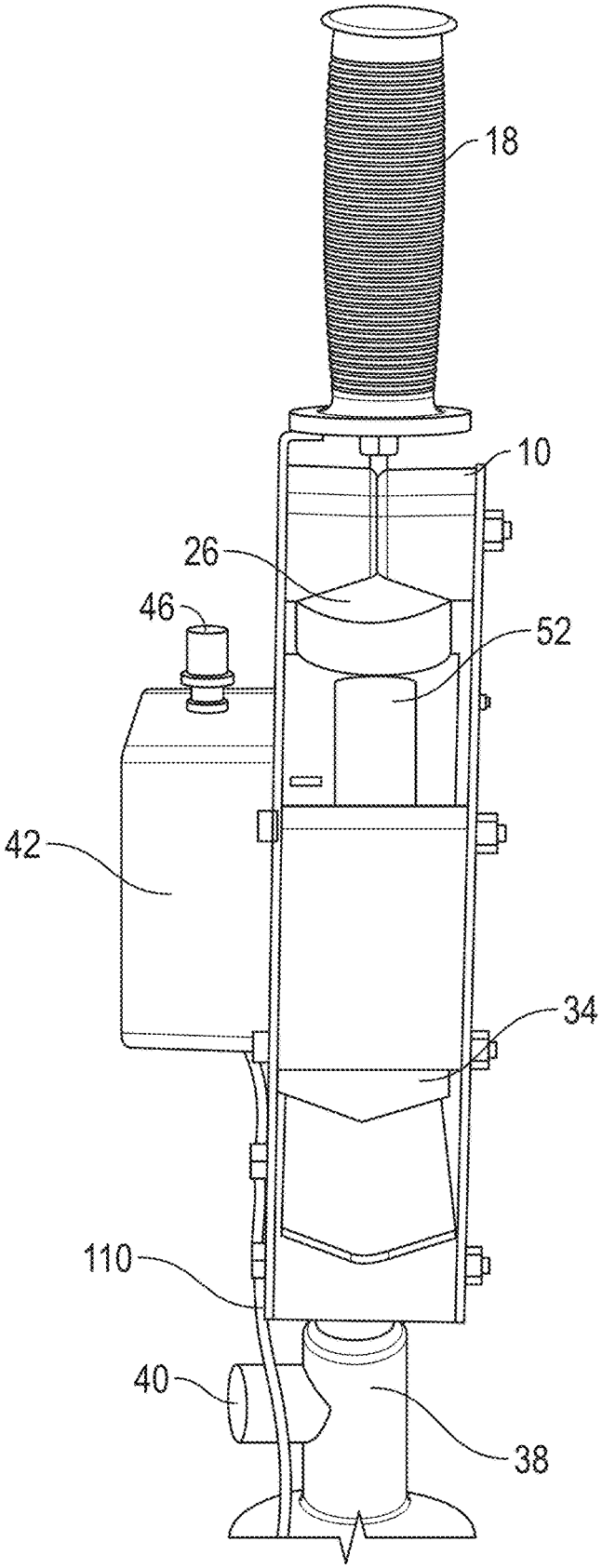
FIG. 15 is a close-up front view of the ball throwing machine from FIG. 13.

FIG. 15 is a close-up front view of the ball throwing machine 10 from FIG. 13.

Figure 16:
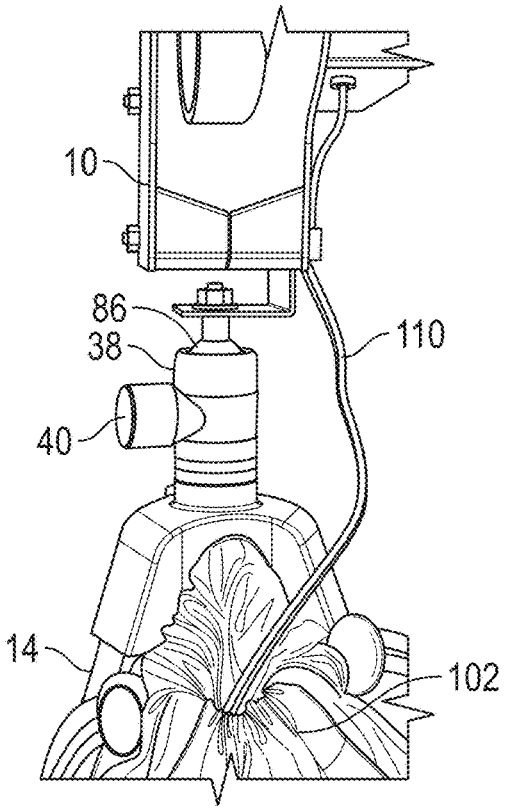
FIG. 16 is a close up of the base and the ball member from the ball throwing machine of FIG. 15.

FIG. 16 is a close up of the base 38 and the ball member 86 from the ball throwing machine of FIG. 15.

Figure 17:
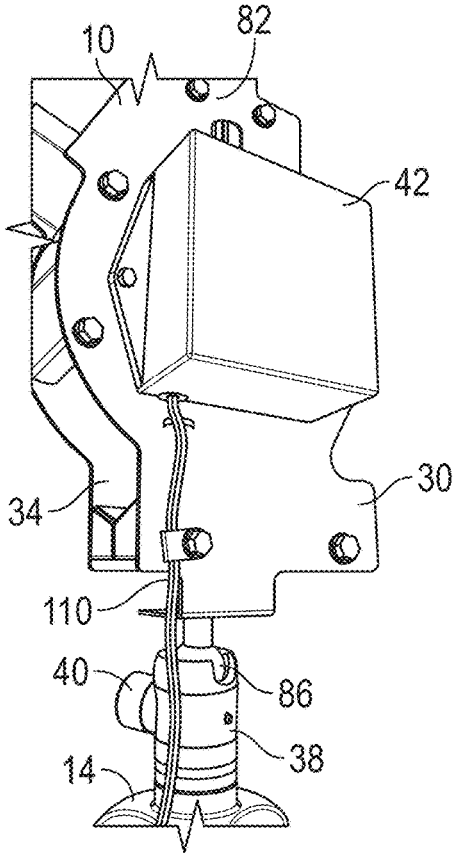
FIG. 17 is a close-up side view of the ball throwing machine from FIG. 16.

FIG. 17 is a close-up side view of the ball throwing machine 10 from FIG. 16.

Figure 18:
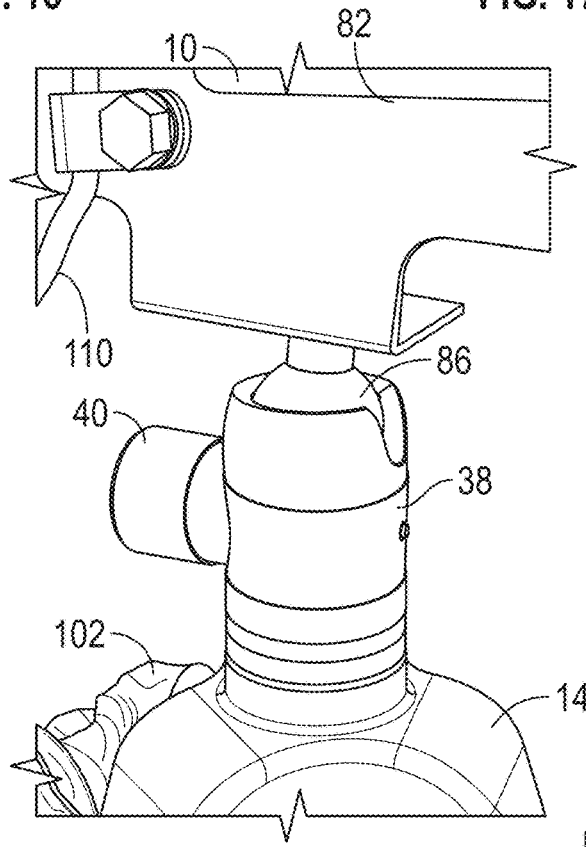
FIG. 18 is a close-up view of the base and ball member of the ball throwing machine of FIG. 17.

FIG. 18 is a close-up view of the base 38 and ball member 86 of the ball throwing machine 10 of FIG. 17.

Figure 19:
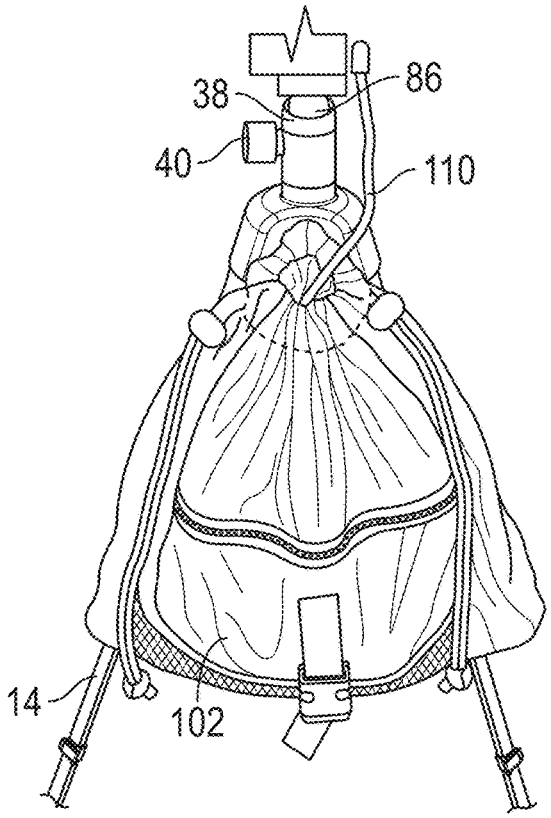
FIG. 19 is a close up of the optional bag.

FIG. 19 is a close up of the optional bag 102. In this view of the bag 102 is shown closed.

Figure 20:
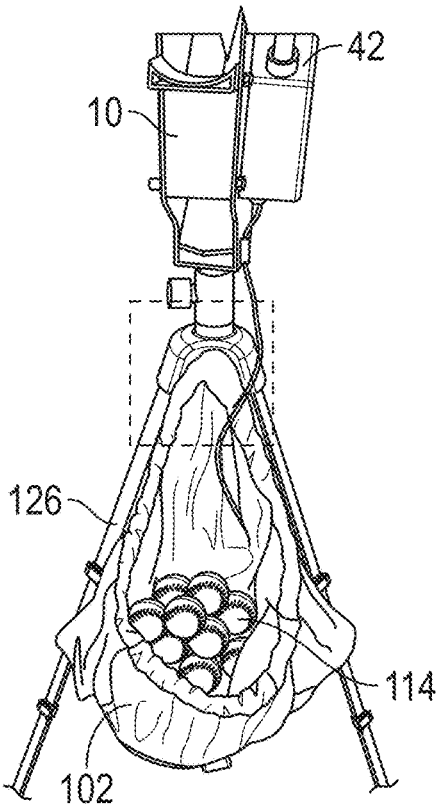
FIG. 20 is a close-up view of the bag from FIG. 19.

FIG. 20 is a close-up view of the bag 102 from FIG. 19, but in this view the bag 102 is opened showing balls 114 inside a main pocket of the bag 102.

Figure 21:
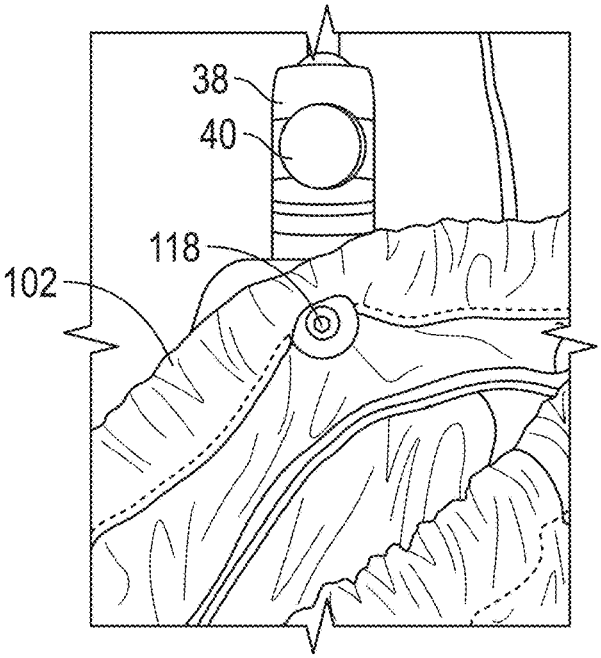
FIG. 21 is a detail view of the bag attached to the tripod.

FIG. 21 is a detail view of how the bag 102 may be attached to the tripod 14 via a fastener such as a screw 118.

Figure 22:
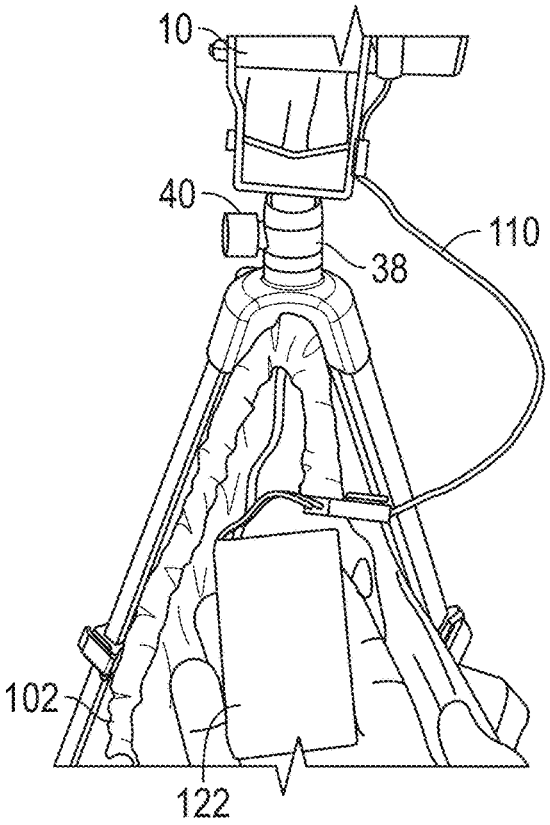
FIG. 22 is a close-up view of a power supply 122 for the motor.

FIG. 22 is a close-up view of a power supply 122 for the motor. In one embodiment, the power supply 122 may be a battery.

Figure 23:
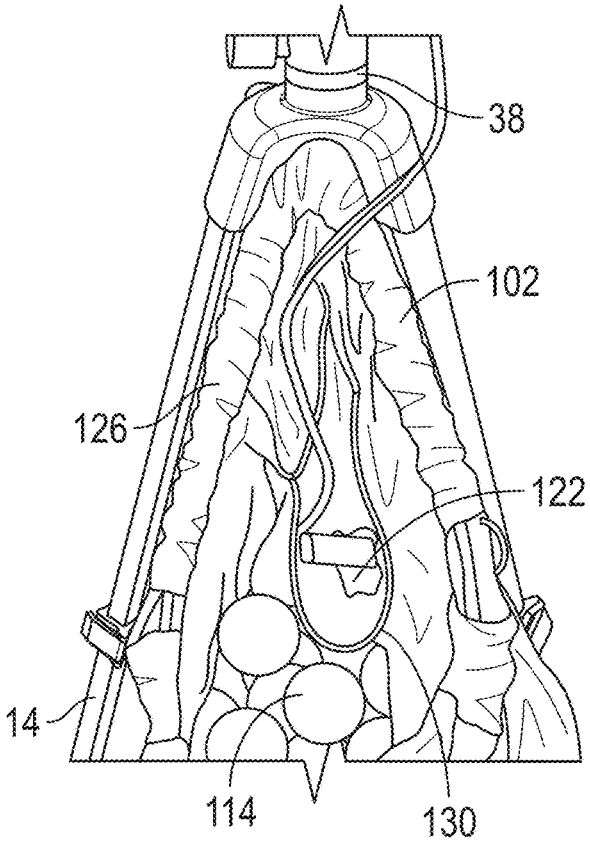
FIG. 23 is a close up view of the bag from FIG. 22.

FIG. 23 is a close up view of the bag 102 from FIG. 22. In this view, the main pocket of the bag may have an internal pocket suitable for holding the power supply 122.

Figure 24:
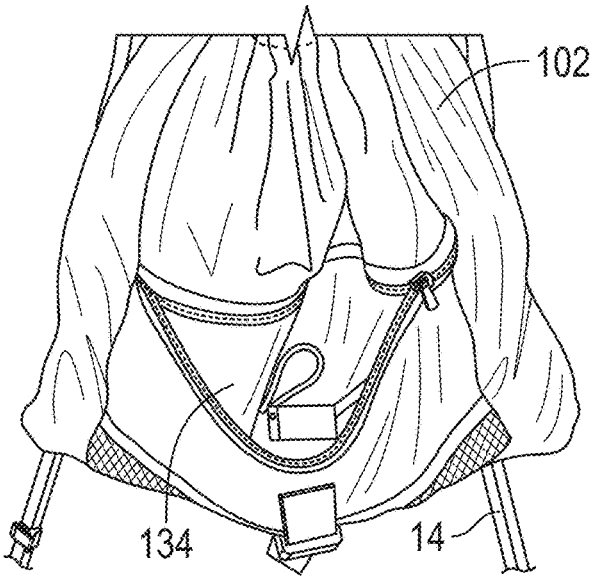
FIG. 24 is a close-up view of the bag from FIG. 23 with the main pocket closed.

FIG. 24 shows the bag 102 from FIG. 23 with the main pocket closed. In this view an outer pocket is shown opened with room for other items.

Figure 25:
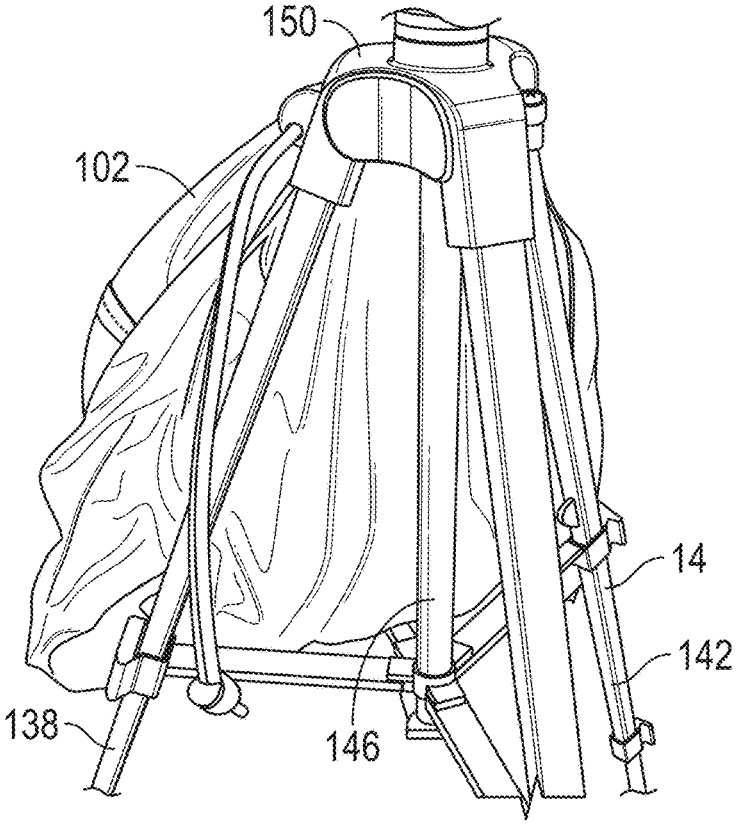
FIG. 25 is a rear view of the optional bag attached to the tripod.

FIG. 25 shows a rear view of the optional bag 102 attached to the tripod 14. In this view, the bag 102 can be seen to at least partially fit within the space defined by 2 legs of the tripod 138, 142, and the center rod 146 of the tripod that extends down from the canopy 150 of the tripod 14.

Figure 26:
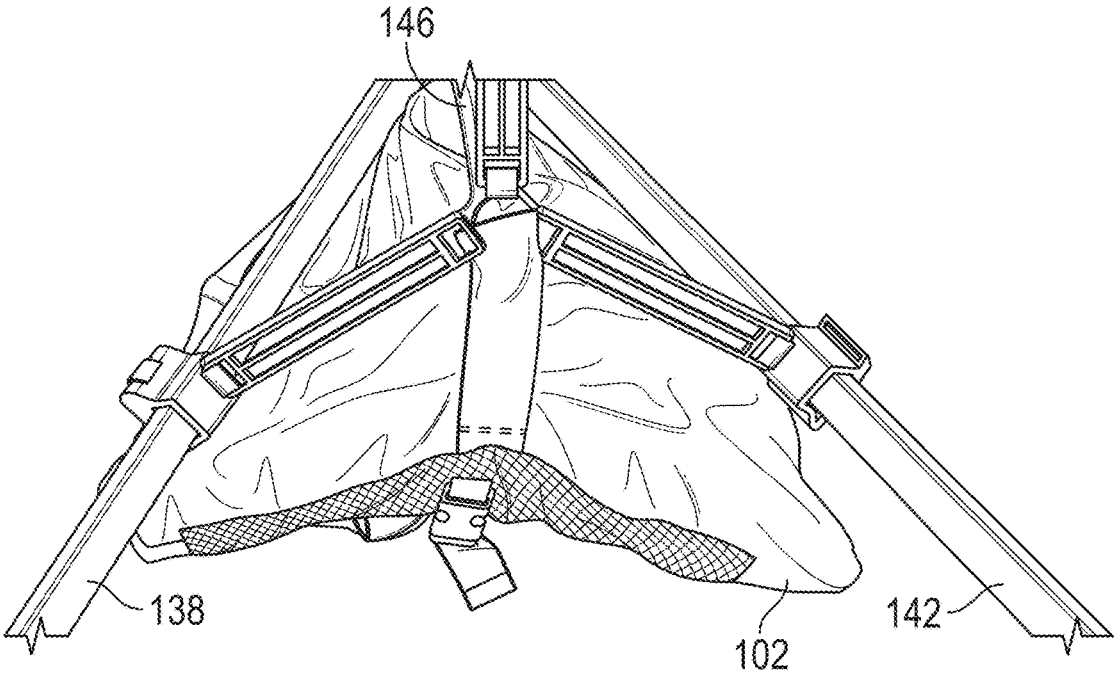
FIG. 26 is a view of the bottom of the bag.

FIG. 26 is a view of the bottom of the bag 142.

Figure 27:
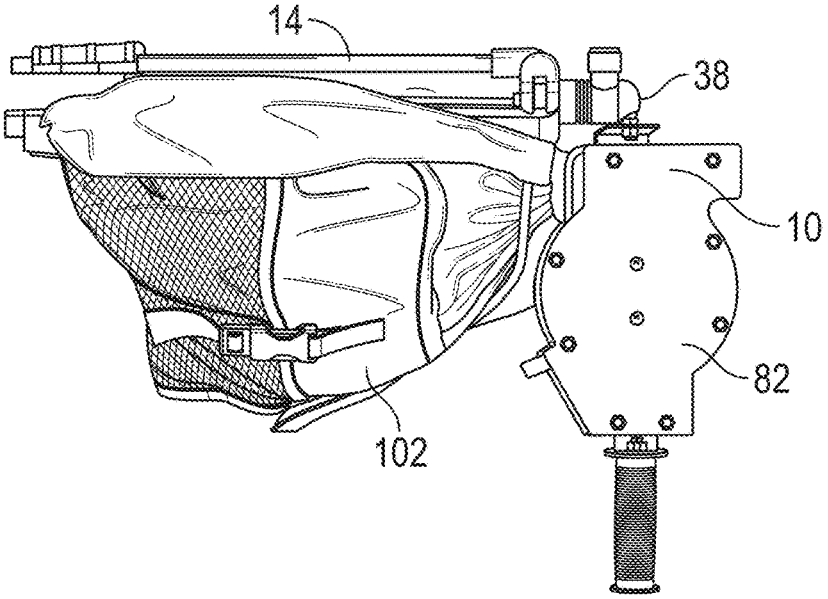
FIG. 27 is a side view of the ball throwing machine and tripod folded up for storage and/or transport.

FIG. 27 is a side view of the ball throwing machine 10 and tripod 14 folded up for storage and/or transport. In this view it can be seen that the housing 82 is rotated about 90° with respect to the base 38.

Figure 28:
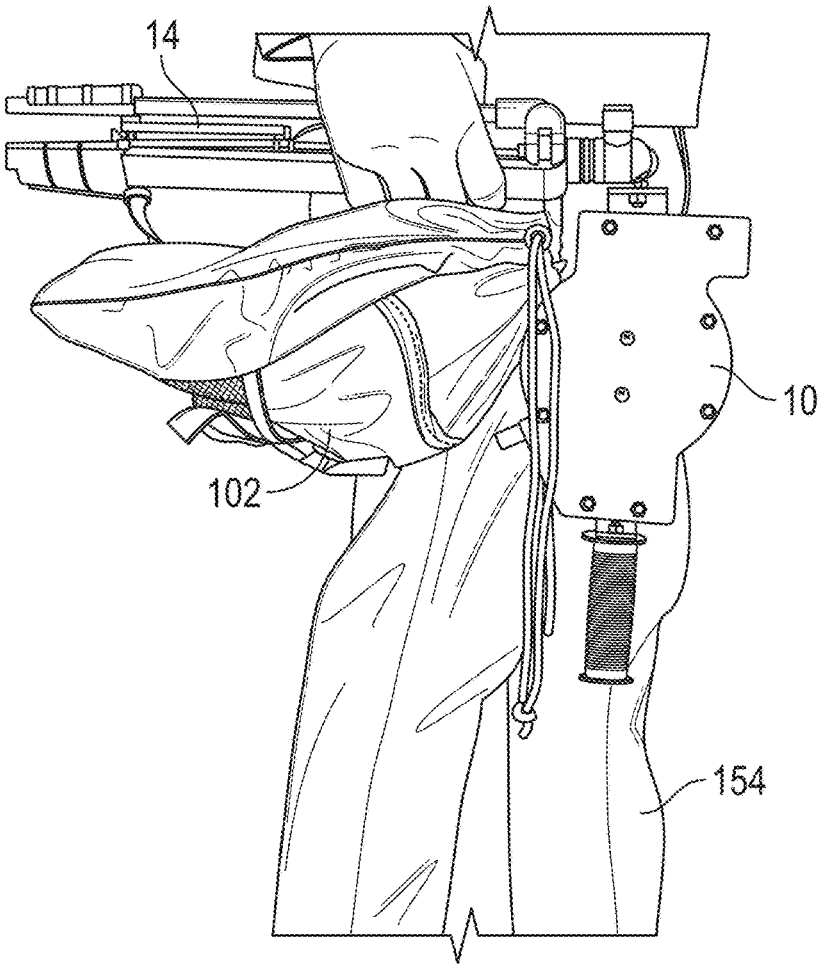
FIG. 28 shows the ball throwing machine and tripod being carried by a user.

FIG. 28 shows the ball throwing machine 10 and tripod 14 being carried by a user 154.

Figure 29:
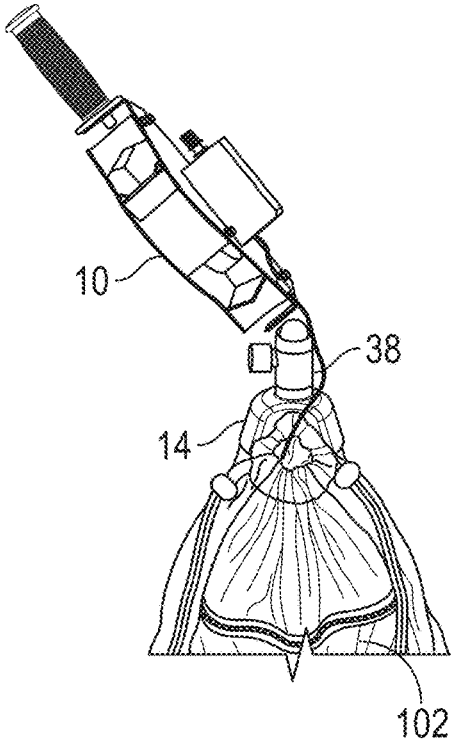
FIG. 29 is a rear view of the ball throwing machine and tripod, with the machine rotated to the left.

FIG. 29 is a rear view of the ball throwing machine and tripod, with the machine 10 rotated to the left by approximately 45° with respect to the base 38.

Figure 30:
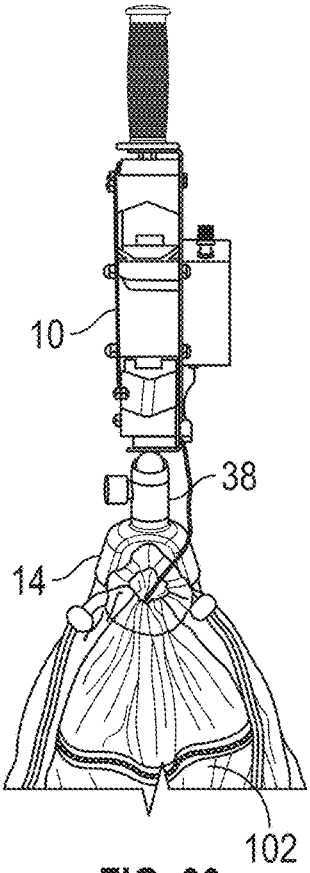
FIG. 30 is a rear view of the ball throwing machine and tripod with the machine not rotated.

FIG. 30 is a rear view of the ball throwing machine and tripod with the machine 10 not rotated with respect to the base 38.

Figure 31:
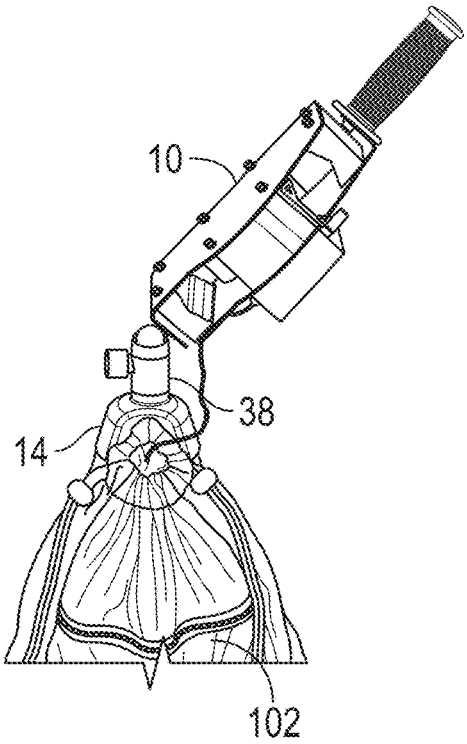
FIG. 31 is a rear view of the ball throwing machine and tripod, with the machine rotated to the right.

FIG. 31 is a rear view of the ball throwing machine and tripod, with the machine 10 rotated to the right by approximately 45° with respect to the base 38.

Figure 32:
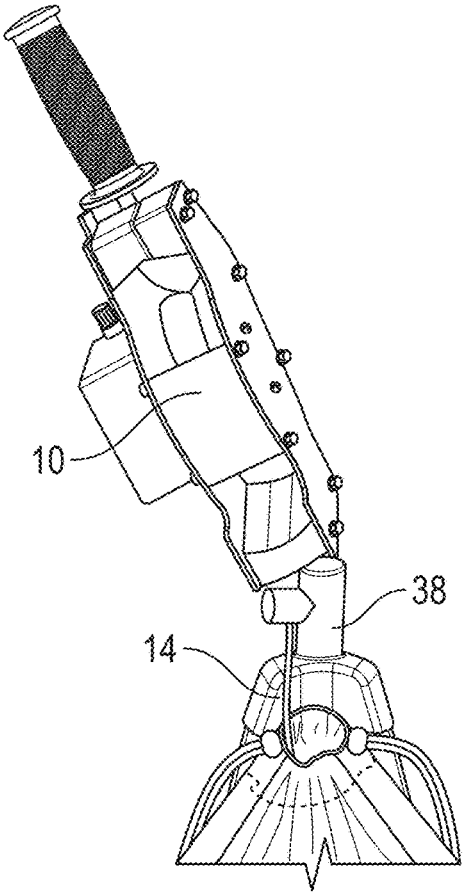
FIG. 32 is a front view of the ball throwing machine and tripod, with the machine rotated to the left.

FIG. 32 is a front view of the ball throwing machine and tripod, with the machine 10 rotated to the left by approximately 30° with respect to the base 38.

Figure 33:
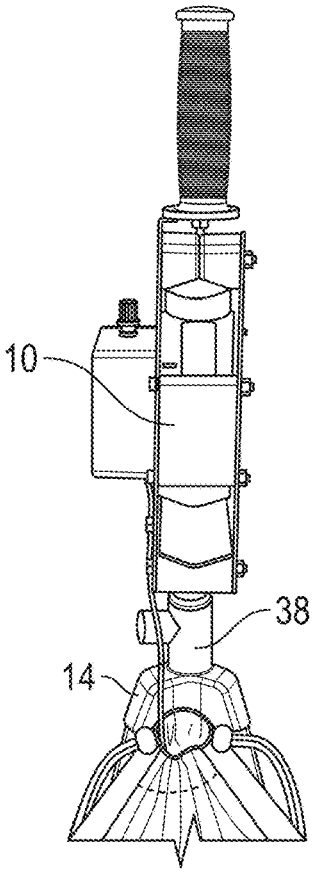
FIG. 33 is a front view of the ball throwing machine and tripod with the machine not rotated.

FIG. 33 is a front view of the ball throwing machine and tripod with the machine 10 not rotated with respect to the base 38.

Figure 34:
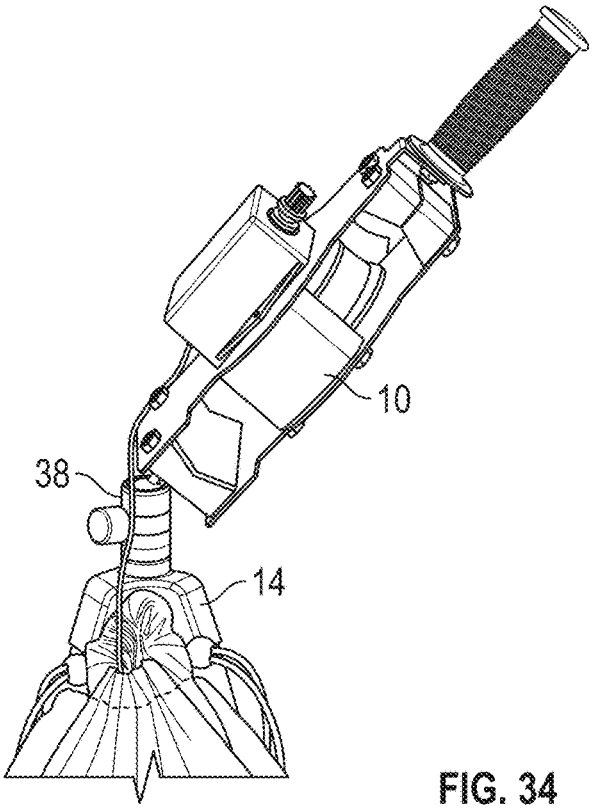
FIG. 34 is a rear view of the ball throwing machine and tripod, with the machine rotated to the right.

FIG. 34 is a rear view of the ball throwing machine and tripod, with the machine 10 rotated to the right by approximately 45° with respect to the base 38.

Figure 35:
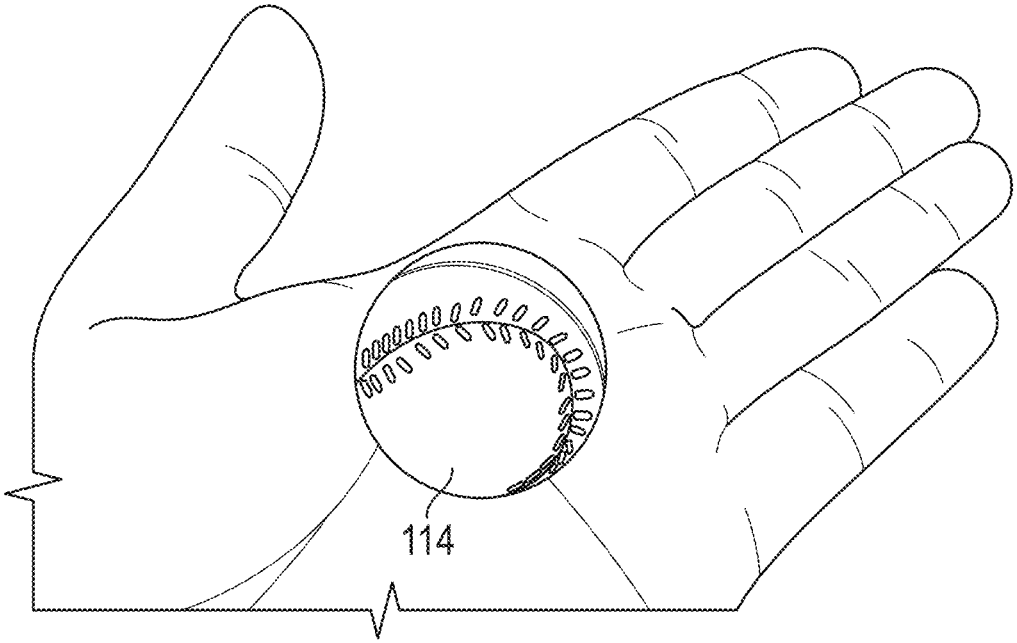
FIG. 35 is a front view of a ball.

FIG. 35 is a view of a ball 114 that can be used by the ball throwing machine 10. The machine 10 may be sized to accept various sized balls, including but not limited to full size baseballs, softballs, etc.

The disclosed ball throwing machine has many advantages. The ball throwing machine can be easily manipulated by the machine operator allowing them to rapidly change the ball's trajectory, position and speed. The operator merely needs to loosen the locking knob, and can change the trajectory, position and speed by moving the handle to position the machine as desired and controlling the speed with the motor control knob. The operator can lock the ball throwing machine in place with the locking knob. The operator can have the machine impart topspin or underspin to the ball simply by rotating the machine 180°. The ball throwing machine may be configured to work with a variety of ball sizes, ball materials, and ball weights.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A ball throwing machine system comprising:

a housing, the housing comprising a bottom of the housing;

an adjustable stand with a base, the base in operational communication with the bottom of the housing via a mechanical joint means, and wherein the housing can lockably move with respect to the base, a first ball inlet located in the housing;

a first ball corridor integrated and fixed in the housing and in communication with the first ball inlet;

a first ball outlet located in the housing and in communication with the first ball corridor and the first ball inlet;

a second ball inlet located in the housing;

a second ball corridor integrated and fixed in the housing, the second ball corridor located below the first ball corridor and in communication with the second ball inlet;

a second ball outlet located in the housing and in communication with the second ball corridor and the second ball inlet;

a single wheel configured to rotate at user adjustable speeds, and further configured to impart spin and velocity to a ball, wherein an outer surface of the single wheel is located on a floor of the first ball corridor, and wherein the outer surface of the single wheel is located on a ceiling of the second ball corridor; and wherein the first ball corridor is enclosed on both its sides and ceiling by the housing, and further enclosed by the single wheel at the floor of the first ball corridor, wherein the second ball corridor is enclosed on both its sides and floor by the housing and further enclosed by the single wheel at the ceiling of the second ball corridor, and wherein the first ball inlet is located directly above the second ball outlet, and the first ball outlet is located directly above the second ball inlet.

2. The ball throwing machine system of claim 1, wherein the adjustable stand is a tripod.

3. The ball throwing machine system of claim 1, wherein the housing can rotate with respect to a base, the housing can pivot forward and backward with respect to the base, and the housing can pivot left to right with respect to the base.

4. The ball throwing machine system of claim 1, wherein the housing comprises a vertical handle extending from a top of the housing.

5. The ball throwing machine system of claim 1, further comprising:

a motor in operational communication with the single wheel;

a speed control knob in operational communication with the motor, wherein the speed control knob is configured to allow a user to change speed of rotation of the single wheel.

6. The ball throwing machine system of claim 1, the ball throwing machine configured to impart an underspin to a ball when the ball is fed into the first ball inlet, and the ball throwing machine configured to impart a topspin to a ball when the ball is fed into the second ball inlet.

7. The ball throwing machine system of claim 2, further comprising a bag that is attachable to the tripod, with the bag configured to partially fit within space defined by 2 legs of the tripod, and below a canopy of the tripod.

8. The ball throwing machine system of claim 1, further comprising a feeder ramp located at the first ball inlet, the feeder ramp being at inclined angle to allow for feeding of a ball into the first ball inlet, and the angle of the feeder ramp configured to allow gravity to pull the ball down into the inlet and onto the first ball corridor.

9. A ball throwing machine comprising:

a housing, the housing comprising a bottom of the housing;

a first ball inlet located in the housing;

a first ball corridor integrated and fixed in the housing and in communication with the first ball inlet;

a first ball outlet located in the housing and in communication with the first ball corridor and the first ball inlet;

a second ball inlet located in the housing;

a second ball corridor integrated and fixed in the housing, the second ball corridor located below the first ball corridor and in communication with the second ball inlet;

a second ball outlet located in the housing and in communication with the second ball corridor and the second ball inlet;

a single wheel configured to rotate at user adjustable speeds, and further configured to impart spin and velocity to a ball, wherein an outer surface of the single wheel is located on the floor of the first ball corridor, and wherein the outer surface of the single wheel is located on a ceiling of the second ball corridor;

and wherein the bottom of the housing is configured to moveably and lockably attach to an adjustable stand; wherein the housing can lockably move with respect to the adjustable stand; wherein the first ball corridor is enclosed on both its sides and ceiling by the housing, and further enclosed by the single wheel at the floor of the first ball corridor; wherein the second ball corridor is enclosed on both its sides and floor by the housing, and further enclosed by the single wheel at the ceiling of the second ball corridor; and wherein the first ball inlet is located directly above the second ball outlet, and the first ball outlet is located directly above the second ball inlet.

10. The ball throwing machine of claim 9, wherein the adjustable stand is a tripod.

11. The ball throwing machine of claim 9, wherein the housing can rotate with respect to the adjustable stand, the housing can pivot forward and backward with respect to the adjustable stand, and the housing can pivot left to right with respect to the adjustable stand.

12. The ball throwing machine of claim 9, wherein the housing comprises a vertical handle extending from a top of the housing.

13. The ball throwing machine of claim 9, further comprising:

a motor in operational communication with the single wheel;

a speed control knob in operational communication with the motor, wherein the speed control knob is configured to allow a user to change a speed of rotation of the single wheel.

14. The ball throwing machine of claim 9, the ball throwing machine configured to impart an underspin to a ball when the ball is fed into the first ball inlet, and the ball throwing machine configured to impart a topspin to a ball when the ball is fed into the second ball inlet.

15. The ball throwing machine of claim 10, further comprising a bag that is attachable to the tripod, with the bag configured to partially fit within a space defined by 2 legs of the tripod, and below a canopy of the tripod.

16. The ball throwing machine of claim 9, further comprising a feeder ramp located at the first ball inlet, the feeder ramp being at inclined angle to allow for feeding of a ball into the first ball inlet, and the angle of the feeder ramp configured to allow gravity to pull the ball down into the inlet and onto the first ball corridor.

* * * * *